United States Patent [19]

Cooper et al.

[11] 4,346,894

[45] Aug. 31, 1982

[54] DRIVER SKILL TEST FOR TOY MINIATURE VEHICLES

[75] Inventors: Julius Cooper, New Hyde Park; Neil Tilbor, Fresh Meadows, both of N.Y.

[73] Assignee: Ideal Toy Corporation, Hollis, N.Y.

[21] Appl. No.: 200,824

[22] Filed: Oct. 27, 1980

[51] Int. Cl.[3] ..... A63F 9/14

[52] U.S. Cl. ..... 273/86 B; 46/1 K

[58] Field of Search ..... 46/1 K, 259, 258, 257, 46/254, 255, 262; 273/86 B, 86 R

[56] References Cited

U.S. PATENT DOCUMENTS

| | | | |
|---|---|---|---|
| 1,660,715 | 2/1928 | Lingenfelder | 273/86 B X |
| 3,479,031 | 11/1969 | Wood, Jr. | 273/86 B |
| 3,744,795 | 7/1973 | Lipscomb | 273/86 B |
| 4,078,799 | 3/1978 | Lahr | 46/262 X |

*Primary Examiner*—Robert Peshock
*Assistant Examiner*—Mickey Yu
*Attorney, Agent, or Firm*—Richard M. Rabkin

[57] ABSTRACT

A slotless toy vehicle game having a track including spaced sidewalls along which a controllable toy vehicle is guided, depending upon the polarity of current supplied to its motor, includes an interrupted wall track section having elongated openings therein through which the toy vehicle may pass. This track section may be in the form of a bridge and requires the player to control his toy vehicles to switch lanes and avoid falling from the track through the opening in the interrupted wall section.

5 Claims, 7 Drawing Figures

DRIVER SKILL TEST FOR TOY MINIATURE VEHICLES

The present invention relates to toy vehicle games, and particularly to slotless racing type games.

In recent years, slotless toy vehicle race games have become increasingly popular. The demand for this type of game is based, in part, upon the high degree of realism in the game as the result of the ability of the players to cause toy vehicles to change lanes during a simulated race at substantially any point along the track. The players can control their respective toy vehicles' speed and position on the track to pass one another or to pass drone cars on the track. One such game, presently commercially available, is sold under the trademark "TOTAL CONTROL RACING" by the Ideal Toy Corporation. That game is disclosed in detail in U.S. Pat. No. 4,078,799, the disclosure of which is incorporated herein by reference.

It is an object of the present invention to provide an improved slotless race game having an added degree of difficulty for the players.

Yet another object of the present invention is to provide a slotless race game wherein an obstacle is provided requiring the players to cause their respective toy vehicles to switch lanes while moving along the track.

A still further object of the present invention is to provide an improved toy vehicle game.

Another object of the present invention is to provide a toy vehicle game which is relatively simple in construction and durable in operation while having high play value.

In accordance with an aspect of the present invention a toy vehicle game is provided which includes a drive track having a slotless track surface and a pair of laterally spaced upstanding sidewalls spaced from one another to define at least two vehicle lanes permitting toy vehicles to move along the track surface in two generally parallel paths of travel. At least one toy vehicle is provided for use on the track and includes a reversible electric motor and means responsive to the direction of rotation of the drive motor to cause the vehicle to move along the track in guiding engagement with one or the other of the sidewalls depending upon the polarity of current supplied to the motor. Player operable control means enable the player to selectively vary the polarity of current supplied to the motor to cause the toy vehicle to change lanes.

The track includes a track section having an interrupted sidewall portion defining at least one elongated opening therein through which a toy vehicle may pass when moving along the adjacent lane in engagement with the track's sidewall. This construction requires the player to operate his control means to cause the vehicle to change lanes in order to remain on the track and avoid passing through the opening and off of the track. The provision of the interrupted track section creates an increased degree of difficulty in operating the game as the players must rely on quickness and dexterity to control their toy vehicles to remain at optimum speed while avoiding falling from the track.

The above, and other objects, features and advantages of this invention will be apparent from the following detailed description of an illustrative embodiment thereof, which is to be read in connection with the accompanying drawings, wherein.

Figures 2, 3, 4, 5:
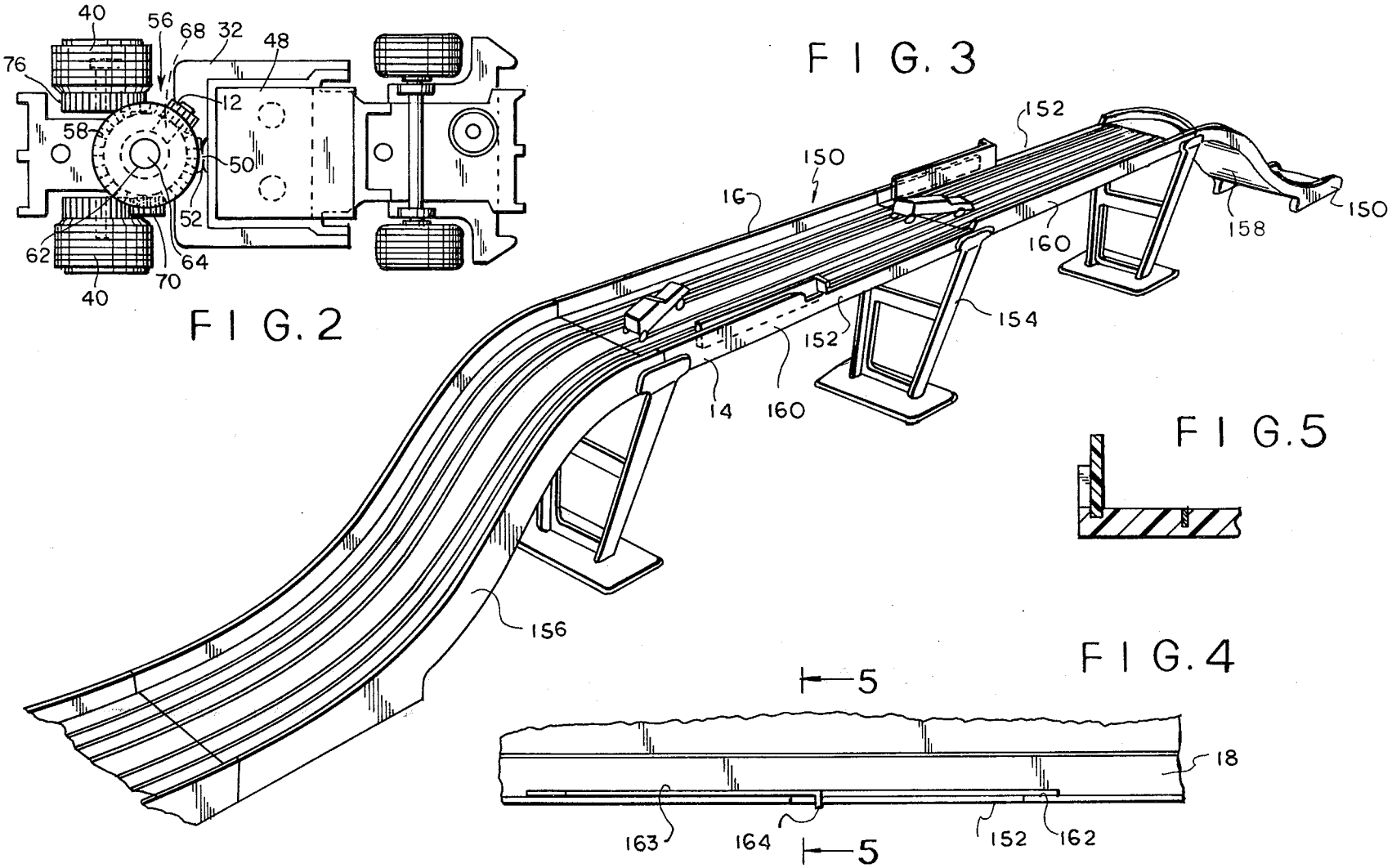
FIG. 2 is a plan view of a controllable toy vehicle used in the game of the present invention, but with the body removed.
FIG. 3 is an enlarged perspective view of the interrupted wall track section constructed in accordance with the present invention.
Figure 3A:
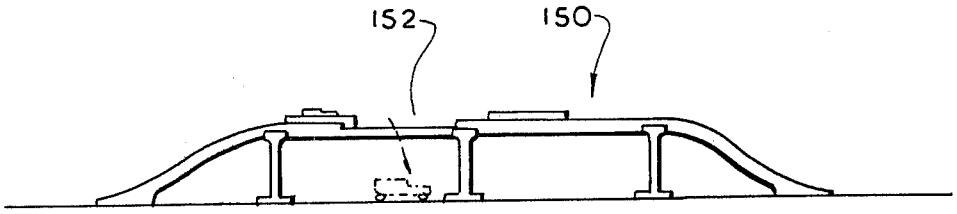

FIG. 3*a* is side elevational view on a reduced scale of the interrupted track section shown in FIG. 3;

FIG. 4 is a plan view of the interrupted wall of the track section shown in FIG. 3, illustrating the adjustment mechanism for varying the length of the opening;

FIG. 5 is a sectional view taken along line 5—5 of FIG. 4; and

Figure 1:
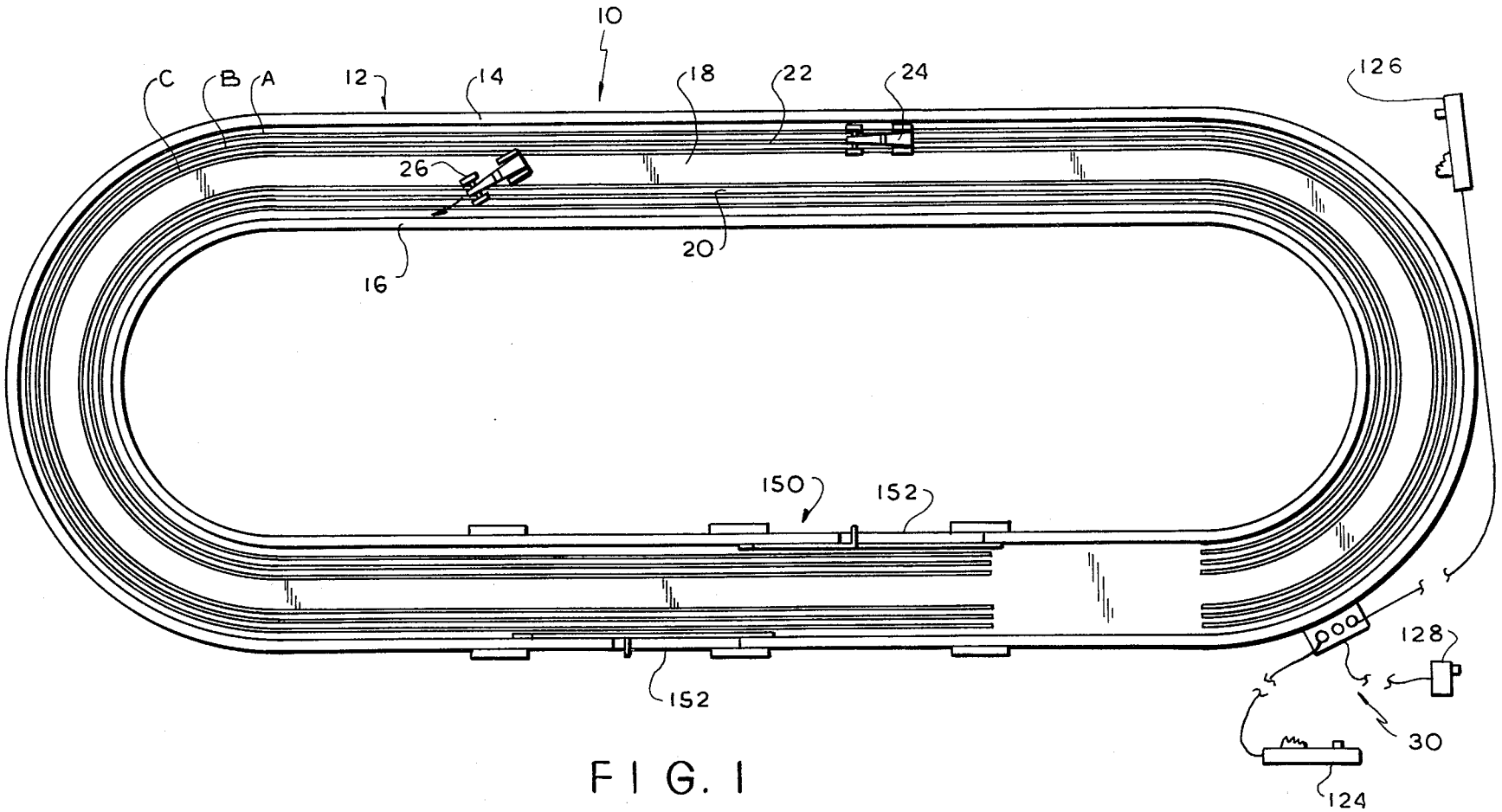
FIG. 1 is a plan view of a toy vehicle game constructed in accordance with the present invention.
Figure 6:
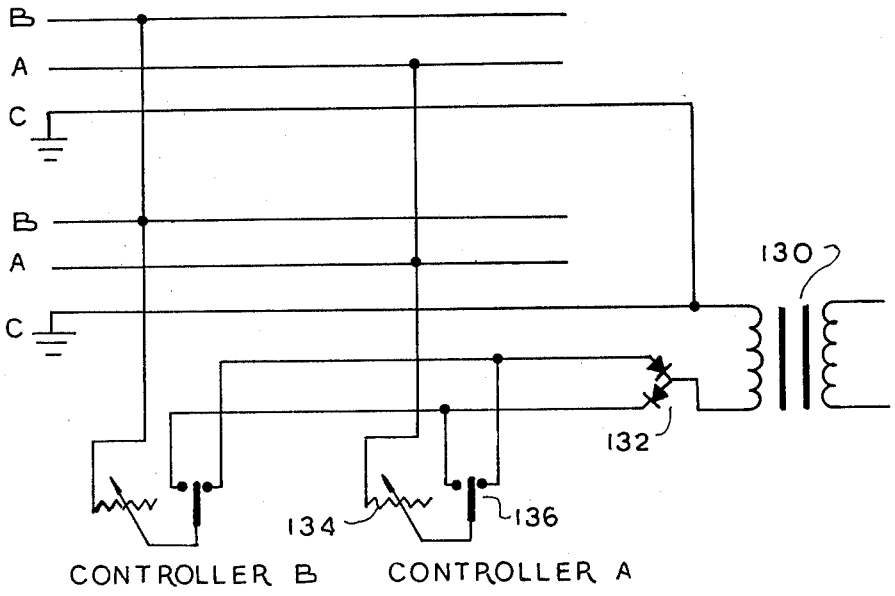

FIG. 6 is a schematic electrical circuit diagram of the electrical control system used for the toy vehicle game of FIG. 1.

Referring now to the drawings in detail, and initially to FIG. 1 thereof, toy vehicle game 10 constructed in accordance with the present invention includes an endless plastic track 12 having a pair of laterally spaced upstanding sidewalls 14, 16, and a road bed or track surface 18 extending therebetween. The road bed has a width sufficient to define at least two vehicle lanes 20, 22 thereon along which a plurality of vehicles can be operated.

In the illustrative embodiment of the present invention, the toy vehicle game includes operator controlled vehicles 24, 26 which are of substantially identical construction except for the arrangement of current collectors thereon as described in U.S. Pat. No. 4,078,799. The vehicles are separately controlled by the players through a control system 30 which enables the players to vary current supplied to the electric motors in the vehicles, thereby to vary the vehicle speed. The controllers also enable the players to change the polarity of current supplied to the respective vehicle motors, whereby the vehicles can be switched by the players from one lane to the other.

As mentioned, the controllable toy vehicles 24, 26 are constructed as described in U.S. Pat. No. 4,078,799. One of these vehicles is shown for illustrative purposes in FIG. 2, wherein it is seen that the vehicle includes an electric motor 48 mounted on a frame 32 in any convenient manner. The electric motor is of conventional DC construction and includes a rotary output member or shaft 50 connected to the rotor of the motor in the usual manner. In the embodiment illustrated in FIG. 2, a spur gear or output drive element 52 is secured to shaft 50 for rotation thereby. This output member is drivingly engaged with the transmission system 56 which is responsive to the direction of rotation of the output element 52 to selectively drive the drive wheels 40.

The transmission system 56 includes a crown gear 58 having downwardly extending teeth rotatably mounted on a pin 64 secured to frame 32 so that the crown gear can freely rotate thereon. A movable transmission element including a sleeve or gear support member 68 is rotatably mounted on the collar 62 of gear 58 surrounding pin 64. A pair of spur gears 70, 72 are in turn rotatably mounted on sleeve 68 for rotation along axes extending generally perpendicularly to the axis of rotation of the crown gear 58.

By this arrangement when motor 48 is operated crown gear 58, due to its engagement with spur gear 52, will be rotated in either a clockwise or counterclockwise direction depending upon the polarity of current supplied to motor 48. At the same time, gears 70, 72 will be continuously rotated by the crown gear. However, because gears 70, 72 are mounted on sleeve 68 the engagement between gears 50, 58, 70, 72 will force sleeve 68 and thus gears 70, 72 to rotate axially about pin 64 in collar 62, in a clockwise or counterclockwise direction according of direction of rotation of the crown gear. As a result, as crown gear 58 is rotated one or the other gears 70, 72 will be engaged with one or the other of gears 46 formed on the inner sides of the gear wheels 40 of the vehicle. Thus, in the configuration shown in FIG. 2, the right wheel of the vehicle will be driven while the left wheel will free-wheel.

In the game illustrated in FIG. 1, one vehicle is in the outside lane 22 and power is supplied to its right wheel 40. As a result of the polarity of current supplied to motor 48 the toy vehicle will be caused to move from the outer lane to the inner lane, as is also shown in FIG. 1 for vehicle 26. When this occurs the front end of the vehicle will engage inner wall 16 of the track and the continued drive of its right wheel will cause the vehicle to move along wall 16 in the inner lane of the track. On the other hand, when the polarity of current supplied to motor 48 is reversed crown gear 58 will rotate in a counterclockwise direction causing gear 72 to engage gear 76 of the left drive wheel (i.e. the upper wheel in FIG. 2) so that this wheel is driven while the right wheel is free to rotate.

When the left wheel of the vehicle is driven in this manner a bias is applied to the vehicle which will cause it to move to the right, that is, into outer lane 22 of the track.

In order to supply current to the toy vehicle, track surface 18 is provided with a plurality of electrical contact strips in each of lanes 20, 22. In the illustrative embodiment of the invention, each lane is provide with three contact strips A, B and C, respectively. As described in the above-mentioned patent, these strips are electrically connected to each other, with the C strips being connected to ground and the A and B strips separately supplying current and control polarity thereof to the respective vehicles, so that two vehicles can operate in the same lane but still be separately controlled.

Control system 30 for the toy vehicle includes respective controllers 124, 126 by which the players can control the respective vehicles 24, 26. The control system includes a plug 128 by which the system is connected to an electrical AC power supply, the plug includes an integral transformer 30 and power is supplied from the transformer through a half-wave rectifier 132 including two diodes connected as shown in FIG. 6 to separately supply current to controllers 124, 126. Each controller is provided as a handheld unit and includes a variable resistor 134 operated as a trigger on the unit, as well as a single pole double throw switch 136. Current from controller 124 is supplied through its variable resistor 134 to the contact strips B and current from controller 126 is supplied through its variable resistor to contact strips A. The variable resistors may be of any convenient construction to permit the operators to vary the current supplied to their respective contact strips and thus their respective vehicles in order to vary the speed of the vehicles.

The polarity of current supplied to the toy vehicles is separately and independently controlled by switches 136 so that the polarity of current supplied to motor 48 of the respective vehicles, as controlled by the respective controllers, will vary in accordance with the position in which switches 136 are placed. By this arrangement, each player, using his controller, can control the speed of his vehicle along the track and he can also variably position the vehicle along the track in one or the other of the track lanes simply by changing the polarity of current supplied to the vehicle, as described in U.S. Pat. No. 4,078,799.

In accordance with a feature of the present invention, toy vehicle game 10 includes a track section 150 including interrupted wall portions defining openings 152 in the walls 14, 16. These interrupted openings define danger zones for the toy vehicles which must be avoided. As mentioned, the vehicles are guided along one or the other of the sidewalls depending upon the polarity of current supplied to them and if they pass along a sidewall towards one of the openings 152 associated therewith, the bias supplied to the vehicles will cause the vehicles to pass out of the opening and thus off the track and out of the game. Accordingly, the players are required, by the presence of these openings, to change lanes before they approach the openings. By providing two openings 152 on walls 14, 16 in longitudinally spaced relation to each other, as shown in FIGS. 1 and 3, the players are required to steer a zigzag pattern through the track section from one lane to the other and back again, in order to avoid both of the openings 152. To make the game more exciting, track section 152 is provided as a bridge, supported by support legs 154 or the like at an elevation above the remainder of the track.

As illustrated in FIG. 3, track section 150 includes two ramp components 156, 158 which lead to the elevated portion of track section 150. The individual track components may be connected together in the known manner used in the "Total Control Racing" game identified above. In the illustrated embodiment of the invention, ramp section 156 includes continuations of the current supply strips A, B and C, as do the elevated portions 160 of the track section. However, to avoid an undesirable increase in speed, due to momentum, which may cause the vehicles to leave the track, the down ramp section 158 does not contain current supply strips. Thus, the toy vehicles will move down that ramp simply as a result of their own momentum and the effects of gravity.

In its simplest form, track section 160 of the present invention may simply have walls 14, 16 formed with longitudinally cutout openings therein so that gaps are formed in the sidewall. In accordance with a further feature of the present invention, however, these gaps or openings 152 are adjustable, so that the degree of difficulty in playing the game can be varied, depending upon the skill of the players.

In the illustrated embodiment this is achieved by providing wall sections 162 consisting of flat planar members, slidably received in recessed grooves 163 formed in track surface 18. Wall sections 162 can slide in the grooves and thus vary the length of openings 152. Preferably, the walls have finger tabs 164 or the like which aid the players in sliding the wall sections, but these tabs are not required.

Although the game has been described as a race game between two controllable vehicles, it is contemplated that the game may include a drone car such as used in the above-mentioned "TCR" games. The drone would be placed on the track to move in the same—or the opposite direction—to the direction of travel of the controllable vehicles. It may also be constrained to move solely on the inside track, by use of a clip or the like as described in U.S. Pat. No. 4,295,649. In that case the inner wall 16 of track section 150 would not be interrupted, i.e. it would not have opening 152 in it. The drone would create an obstacle forcing the players to move their controllable vehicles into the outer lane and risk falling through the opening in wall 140.

Accordingly, it is seen that a relatively simple toy vehicle race game is provided which has an added degree of difficulty for the players in that the players must steer the variable course or pattern along track section 150 in order to avoid having their vehicles leave the track surface.

Although an illustrative embodiment of the present invention has been described herein with reference to the accompanying drawings it is to be understood that the invention is not limited to that precise embodiment, but that various changes and modifications may be effected therein by one skilled in the art without departing from the scope or spirit of this invention.

What is claimed is:

1. In a toy vehicle game including a relatively flat slotless track having spaced sidewalls defining at least a pair of lanes therebetween, at least one controllable toy vehicle including means for biasing said vehicle into one or another of said lanes for guiding engagement with the adjacent track sidewall, and player operable control means for varying the speed of the controllable vehicle and selectively actuating said biasing means to cause said controllable vehicle to switch lanes, the improvement comprising a track section having interrupted sidewall portions in each of said sidewalls through which a vehicle may pass when moving in the adjacent track lane whereby the player must actuate said control means to cause the controllable vehicle to switch lanes from said adjacent track lane to the other lane to avoid having the controllable vehicle leave the track; each of said interrupted sidewalls having an elongated opening formed therein extending parallel to their respective adjacent lanes; and means for adjusting the length of said openings including a wall section slidably mounted in said track section for movement parallel to the track sidewall across its associated opening.

2. A toy vehicle game as defined in claim 1 wherein said track section is a bridge including means for supporting the track section at a higher elevation than adjacent track sections.

3. In a toy vehicle game including a guide track having a slotless track surface and a pair of laterally spaced upstanding sidewalls spaced from one another to define at least two vehicle lanes permitting toy vehicles to move along the track surface in two generally parallel paths of travel, at least one toy vehicle for use on the track, said vehicle including a reversible electric motor and means responsive to the direction of rotation of the drive motor to cause said vehicle to move along the track in guiding engagement with one or the other of said sidewalls, and player operable means for supplying current of variable polarity to said motor, wherein the improvement comprises a track section having interrupted sidewall portions including at least one elongated opening formed in each of said sidewalls through which the vehicle may pass when moving along the adjacent track lane in engagement with the sidewall whereby a player must operate the control means to cause the vehicle to change lanes to avoid passing through said opening and thereby remain on said track; and means for adjusting the size of said opening including a wall section slidably mounted in said track adjacent each of said openings.

4. A toy vehicle game as defined in claim 3 wherein said track section includes means for supporting the track section at an elevation above the remainder of the track.

5. A toy vehicle game as defined in either of claims 1 or 3 including a drone vehicle on the track.

* * * * *